US008096317B2

(12) United States Patent
Uffner et al.

(10) Patent No.: US 8,096,317 B2
(45) Date of Patent: Jan. 17, 2012

(54) WATER POWERED HOSE REEL

(75) Inventors: Michael Uffner, Naperville, IL (US); Michael R. Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 839 days.

(21) Appl. No.: 12/130,093

(22) Filed: May 30, 2008

(65) Prior Publication Data

US 2008/0295894 A1 Dec. 4, 2008

Related U.S. Application Data

(60) Provisional application No. 60/941,460, filed on Jun. 1, 2007.

(51) Int. Cl.
*A62C 35/00* (2006.01)

(52) U.S. Cl. ..... 137/355.2; 137/355.12; 242/389; 242/390.5; 242/407; 74/29

(58) Field of Classification Search ..... 137/355.2, 137/355.12, 355.16; 74/10.39, 29; 242/389, 242/390.5, 407, 390, 250, 256
See application file for complete search history.

(56) References Cited

U.S. PATENT DOCUMENTS

| | | | | |
|---|---|---|---|---|
| 1,489,664 | A * | 4/1924 | Dowrelio | 242/390.1 |
| 2,893,250 | A * | 7/1959 | Moore | 74/29 |
| 4,512,361 | A | 4/1985 | Tisbo et al. | |
| RE32,510 | E | 9/1987 | Tisbo et al. | |
| 4,777,976 | A | 10/1988 | Johnston et al. | |
| 5,046,520 | A | 9/1991 | Sanchez, Jr. et al. | |
| 5,741,188 | A | 4/1998 | Levin et al. | |
| 5,901,730 | A | 5/1999 | Tisbo et al. | |
| 5,998,552 | A | 12/1999 | Gruber et al. | |
| 6,050,291 | A | 4/2000 | Whitehead et al. | |
| 6,752,342 | B1 * | 6/2004 | Nagler | 242/390.5 |
| 6,834,670 | B2 | 12/2004 | Rosine et al. | |
| 6,877,687 | B2 | 4/2005 | Moon et al. | |
| 6,981,483 | B1 * | 1/2006 | Keip | 123/197.1 |
| 7,017,603 | B1 * | 3/2006 | Rosine et al. | 137/355.12 |
| 7,216,666 | B2 * | 5/2007 | Levy et al. | 137/355.22 |
| 7,559,501 | B2 * | 7/2009 | Jian | 242/389 |
| 7,810,751 | B2 * | 10/2010 | Caamano et al. | 242/397.3 |
| 2006/0045733 | A1 | 3/2006 | Nagler | |

* cited by examiner

*Primary Examiner* — John Rivell
*Assistant Examiner* — Minh Le
(74) *Attorney, Agent, or Firm* — McHale & Slavin, P.A.

(57) ABSTRACT

A water powered hose reel operated by household water pressure. The hose reel has a traversing hydraulic motor for use in retrieval of a flexible hose. The hose reel includes a spool carried by and enclosed within an enclosure, the spool having a hub with a pair of flanges at opposing ends configured for proper alignment of the hose during storage, take-up and pay-out of the hose. The enclosure is configured for receiving the spool so as to rotate within the enclosure. A hydraulic motor allows take-up of the hose by use of a reciprocating traversing motor driving a rack attached to the spool by a series of gears. Disengagement of the motor allows for manual pay-out of the hose.

20 Claims, 16 Drawing Sheets

WATER POWERED HOSE REEL

CROSS-REFERENCE TO RELATED APPLICATIONS

This application claims benefit of the filing date of U.S. Provisional Patent Application No. 60/941,460, filed on Jun. 1, 2007, the contents of which are herein incorporated by reference.

FIELD OF THE INVENTION

This invention pertains to the storage of flexible hoses, and more particularly, to a water powered hose reel having a hydraulic motor operated by municipally supplied water pressure for purposes of winding a hose reel by use of pressurized water.

BACKGROUND OF THE INVENTION

Water hoses are used to transfer water from one location to another, a necessity for homeowners attempting to efficiently water lawns and gardens as well as for general all-around home care. Before the use of hose reels storage systems, water hoses were typically left on the ground in coiled or uncoiled position, either such position exposed the hose to the collection of dirt. If the hose was lifted from the ground the hose may still be stored in an arrangement that would lead to early degradation. The advent of hose reels gained wide public acceptance as a convenient device for properly storing of the water hoses. These devices include portable hose reel carts, stationary hose reel carts, and stationary hose reel hangers that can be mounted to a surface of a building all of which store the water hoses in a location in a convenient area for reuse. The hose reel provided proper coiling of the hose, positioning off of the ground, and in many instance portability in a storage condition.

A typical portable hose reel cart includes an open, rotatable reel or spool positioned between a pair of side frames. These carts include wheels to permit ready transport of the hose from one location to another. The hose is merely wound upon the reel for storage and pulled or dispensed from the reel for use.

The construction of a hose reel is primarily of molded plastic components having a rotatable spool for wheeling of the flexible hose, a frame for supporting of the spool, and a means for rotating of the spool, most commonly performed by a manually operated hand crank. Illustrative of the structure and operation of hose reels and hose reel carts can be viewed and referenced to various patents issued to the Suncast® Corporation such as U.S. Pat. Nos. Reissue 32,510; 4,512,361; 4,777,976; 5,046,520; 5,901,730; 5,998,552; 6,050,291; 6,834,670; 6,877,687; and 7,017,603 the disclosures of which are hereby incorporated by reference.

Common to such hose reels is the use of a crank handle secured to a hub for rotation of the spool. The spools are typically arranged with the crank handle located at the center of the hub to wind the flexible hose. Variations to the use of the hand crank include a battery powered hose reel wherein a small direct current motor obtaining power from a rechargeable battery supply can be coupled to the spool providing rotation. In many instances manual rotation of the spool is not convenient to the consumer. For instance, the consumer may require automatic hose take-up due to a physical aliment or the consumer may simply choose to have the convenience of automatic hose take-up. U.S. Pat. No. 6,877,687 is directed to a battery powered hose reel to provide an alternative to manual cranking of a hose reel. The battery powers a low draw motor allowing hundreds of hose retrievals before recharging, recharging may be performed by coupling to an electrical source such as an AC source or DC solar panel supplied current.

A water powered motor is yet another alternative means that can be used for automatic hose take-up. Various attempts at making water powered motors for use with hose reels can be found in U.S. Pat. No. 5,741,188 directed to a water driven motor having an external gear motor, a linearly translating actuator, and a rotatable actuator; U.S. Pat. No. 6,752,342 discloses the use of a water operated motor for conversion of linear motion to a rotational motion using pistons linked to a spool for rotation in a manner similar to a steam engine; and U.S. Publication No. 2006/0045733 discloses the use of a water turbine for use in rotation of a hose reel.

What is not disclosed in the prior art is a simplified hydraulic motor for use in a water powered hose reel.

SUMMARY OF THE INVENTION

Disclosed is a water powered hose reel driven by a traversing cylinder with a gear rack for use in retrieving a flexible hose. The hose reel includes a spool having a hub and a pair of flanges at opposing ends of the hub configured for storage, take-up and pay-out of the flexible hose. In the preferred embodiment, the hose reel is supported in an enclosure having front and rear wall panels, side wall panels extending between the front and rear wall panels, and a cover. The enclosure is configured for receiving the spool so as to rotate within the enclosure and for storing a length of flexible hose on the spool. The traversing cylinder is operatively associated with the spool by use of a reciprocating rack for driving a series of gears attached to the spool. Disengagement of the traversing cylinder allows for ease of manual pay-out of the hose. Operation of the spool is by of household water pressure. The hydraulic motor provides a reciprocating movement that is converted to rotational movement of the spool via the series of gears for retrieval of an elongated member such as a hose.

Thus, an objective of the invention is to disclose the use of a water powered traversing cylinder with a gear rack to provide rotational movement of a spool.

Another objective of the invention is to disclose the use of a water switching valve assembly allowing reciprocal movement of a traversing cylinder by placement of pressurized water to each side of a piston to cause and maintain a traversing motion.

Still another objective of the invention is to disclose the use of a spring loaded clutch paw to provide unidirectional winding.

Still another objective of the invention is to teach the use of a level winder driven by a powered motor wherein the level winder.

Other objectives, features, and advantages of the invention should be apparent from the following description of the preferred embodiment thereof as illustrated in the accompanying drawing.

DETAILED DESCRIPTION OF THE PREFERRED EMBODIMENT

Figure 1:
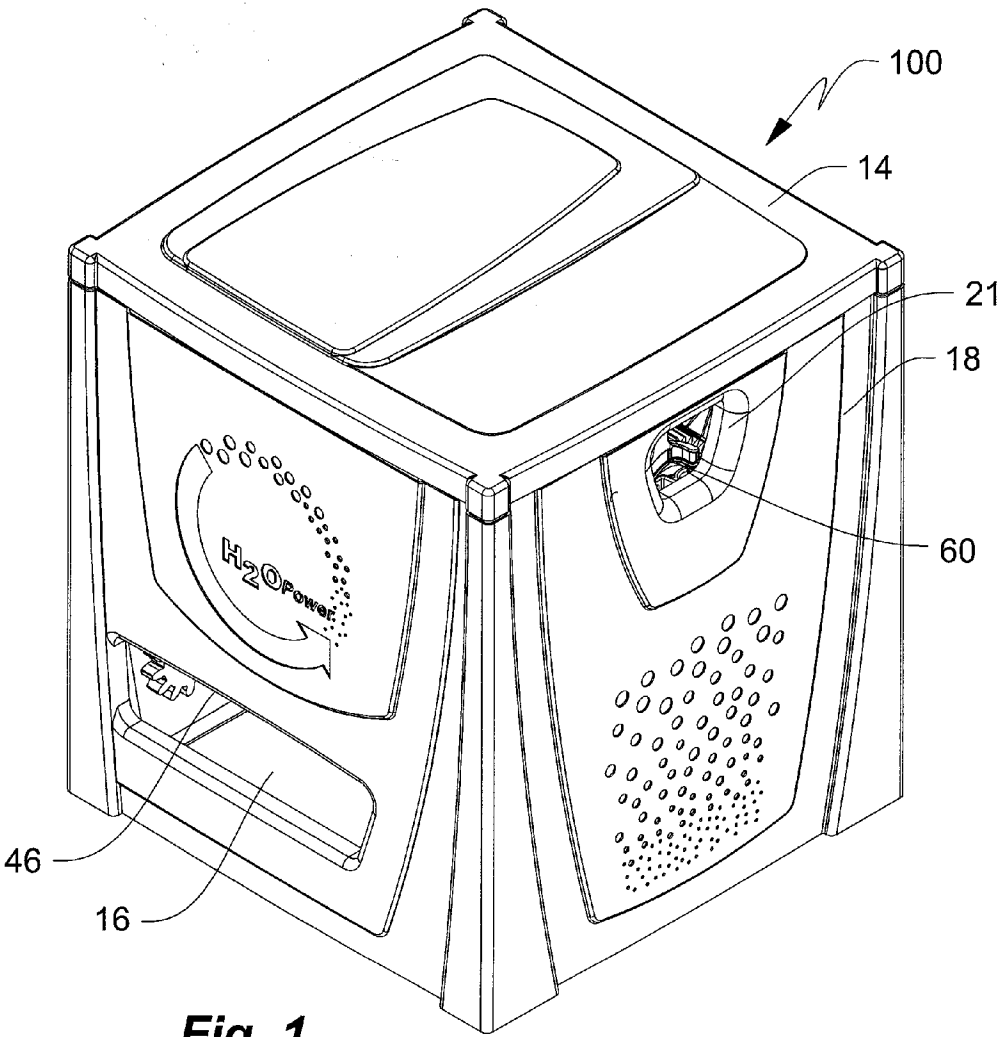
FIG. 1 is a right front perspective view of the water powered hose reel enclosure.
Figure 2:
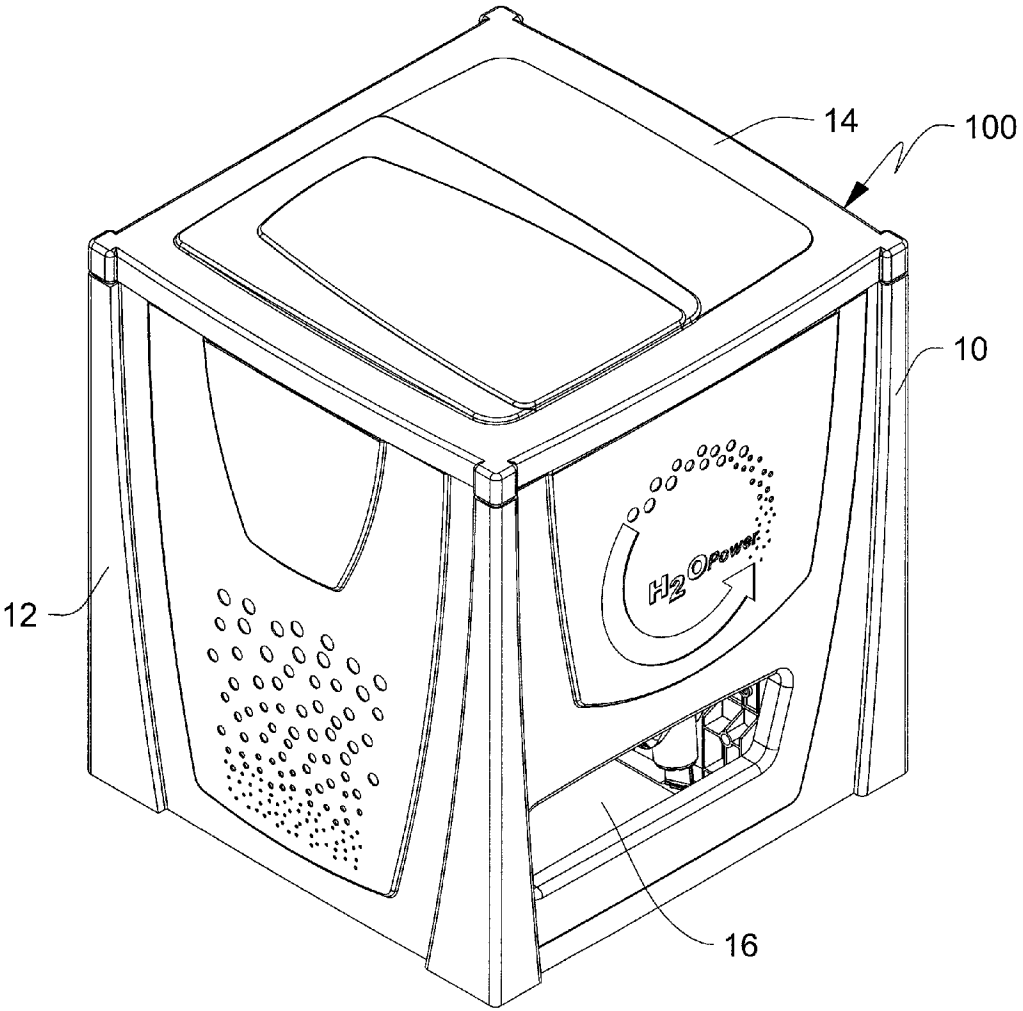
FIG. 2 is a left front perspective view of the water powered hose reel enclosure.
Figure 3:
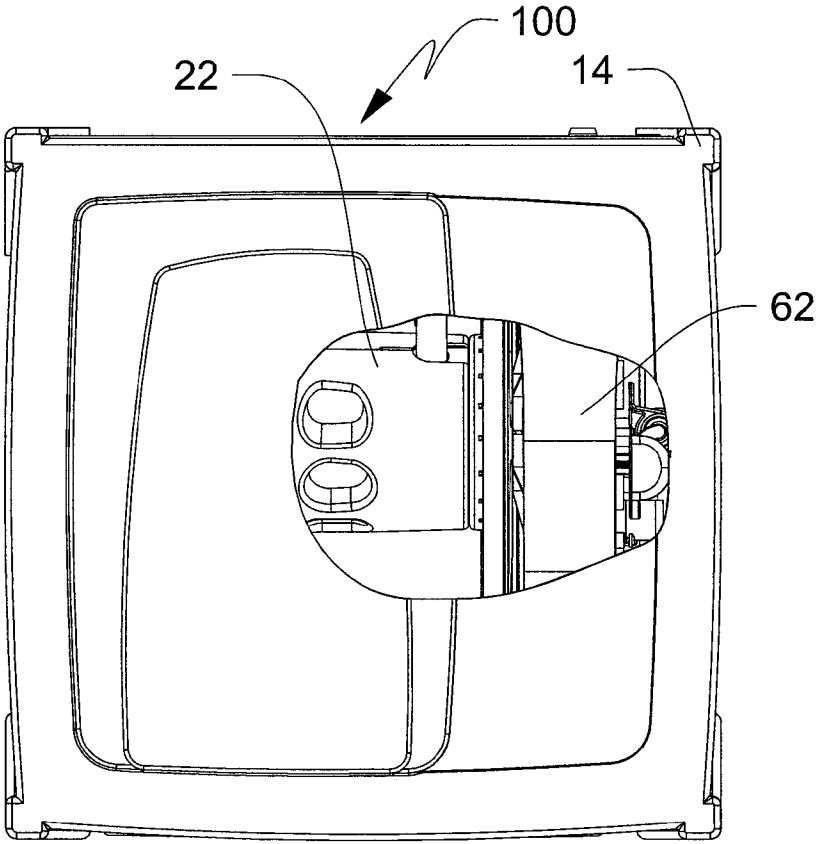
FIG. 3 is a top view of the water powered hose reel enclosure illustrating the spool and motor.
Figure 4:
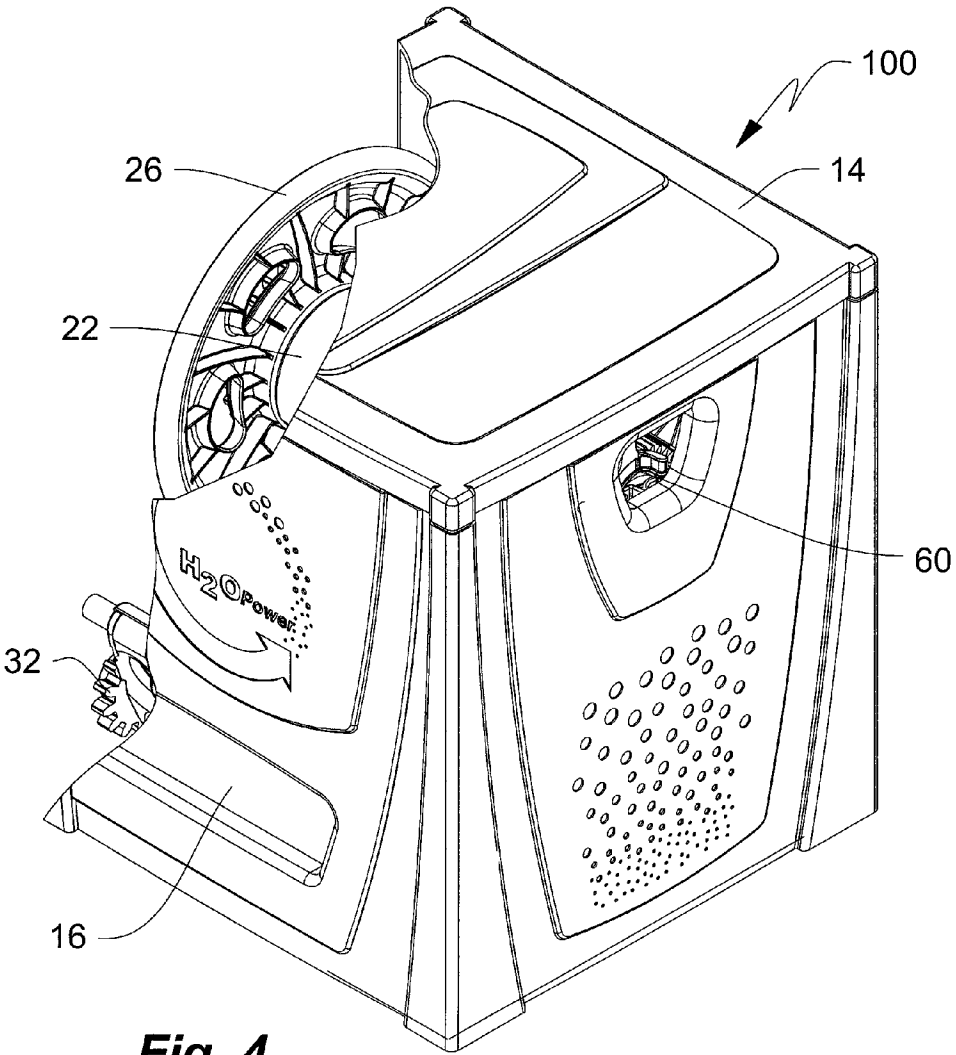
FIG. 4 is a right perspective view of the hose reel enclosure illustrating the spool and motor.

Referring now to the drawings, set forth is a hose reel enclosure 100 having a front wall panel 10, side wall panel 12, and a hinged lid 14. The enclosure 100 is generally constructed and arranged to enclose a spool 20 onto which a flexible elongated member, namely a garden hose, is rotatably wound or taken up, and from which the flexible hose is fed out or paid out. The front wall 10 includes a lower opening 16 to permit the taking up or paying out the garden hose, not shown. A right side wall 18 includes an aperture 21 that allows operation of a handle 60 used for diverting of inlet water and to disengage a gear train to allow a free wheeling of the spool allowing ease of hose removal. The handle 60 further allowing engagement of a hydraulic motor for use in rotating of the spool causing a garden hose to be drawn in as directed by an operator. FIGS. 3-4 set forth a top view and front right perspective view, respectively, showing the enclosure 100 with the spool 20 and motor housing 62 positioned within the enclosure 100.

Figure 12:
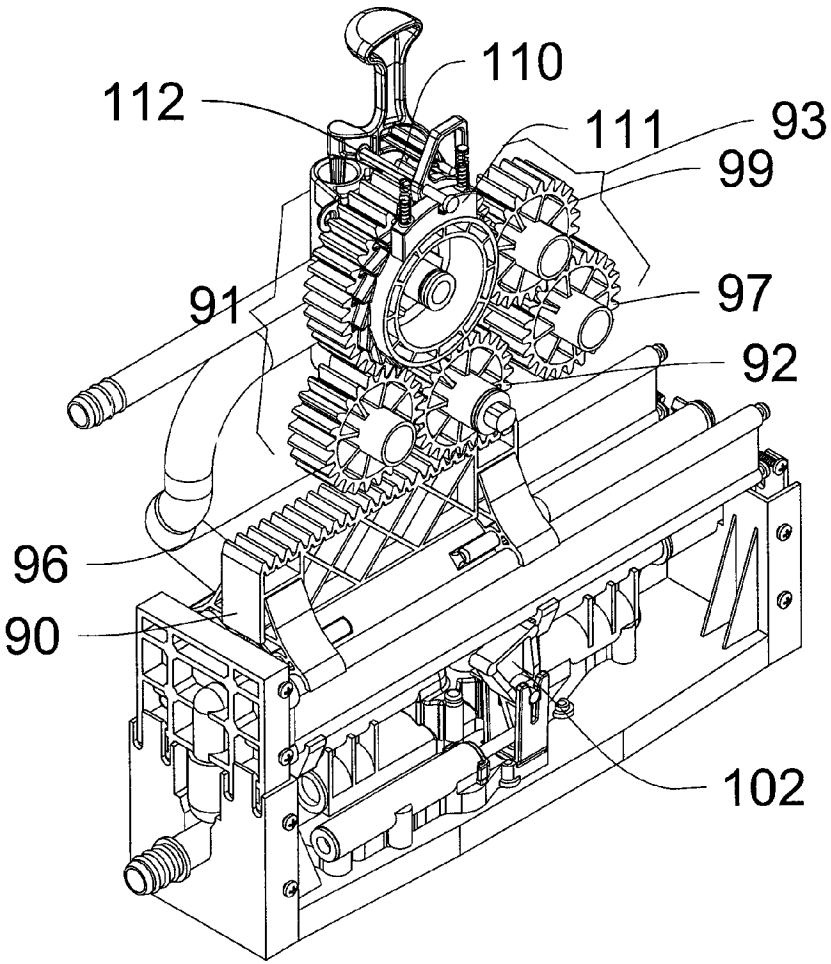
FIG. 12 is an enlarged view of the toggling switch in operation with the traversing cylinder.
Figure 13:
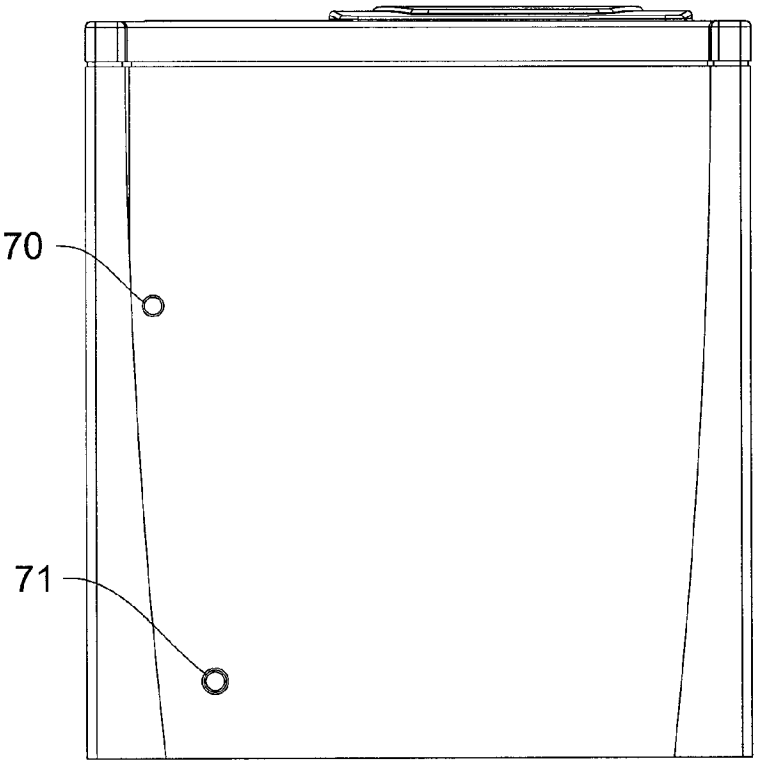
FIG. 13 is a rear perspective view illustrating a water inlet connection and an exhaust port.
Figure 14:
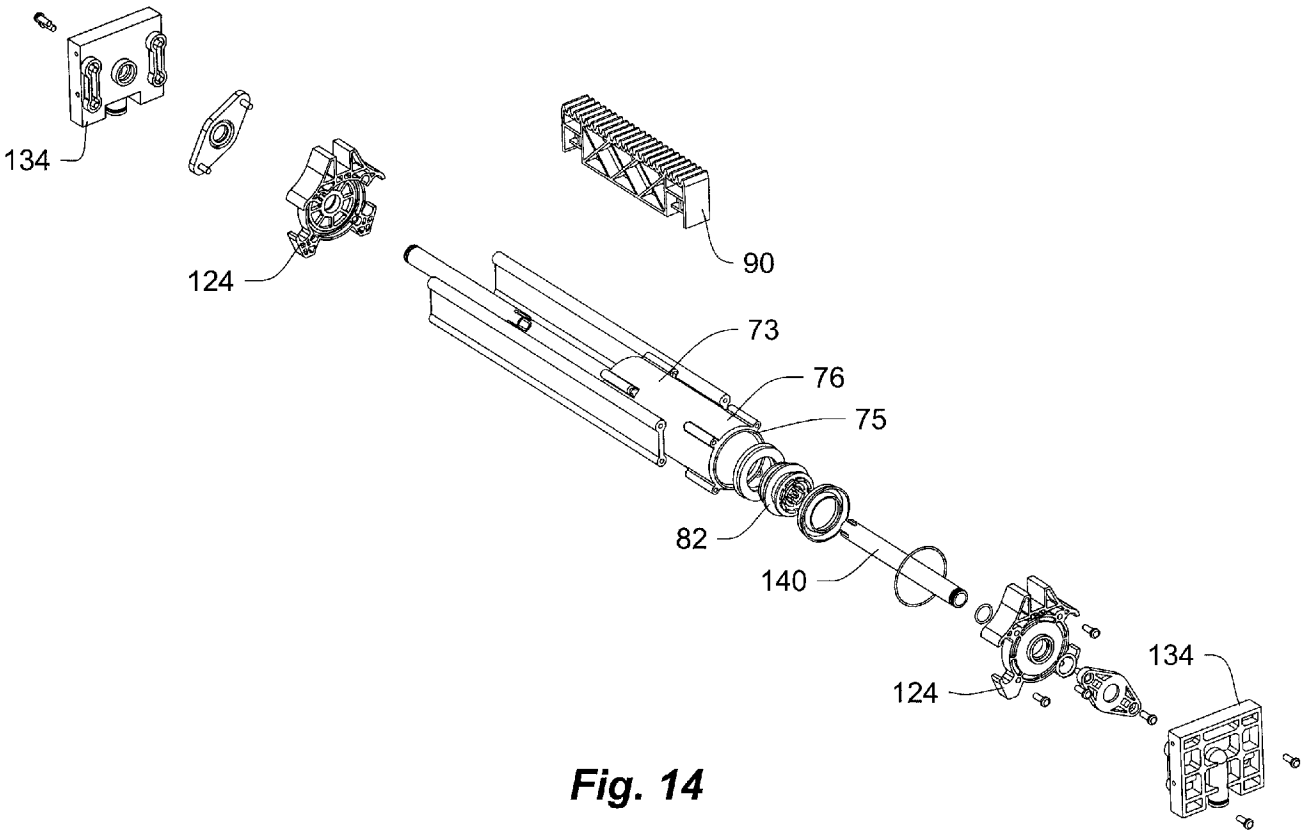
FIG. 14 is an exploded view of the switching assembly.
Figure 15:
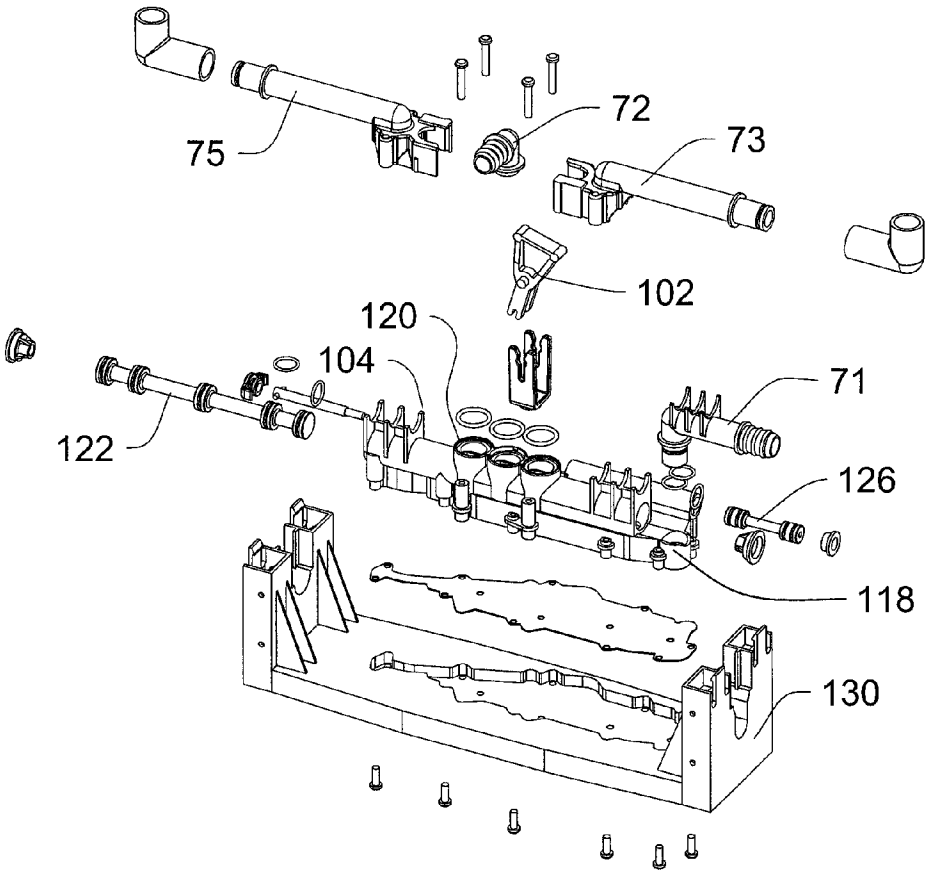
FIG. 15 is an exploded view of the traversing cylinder.
Figure 16:
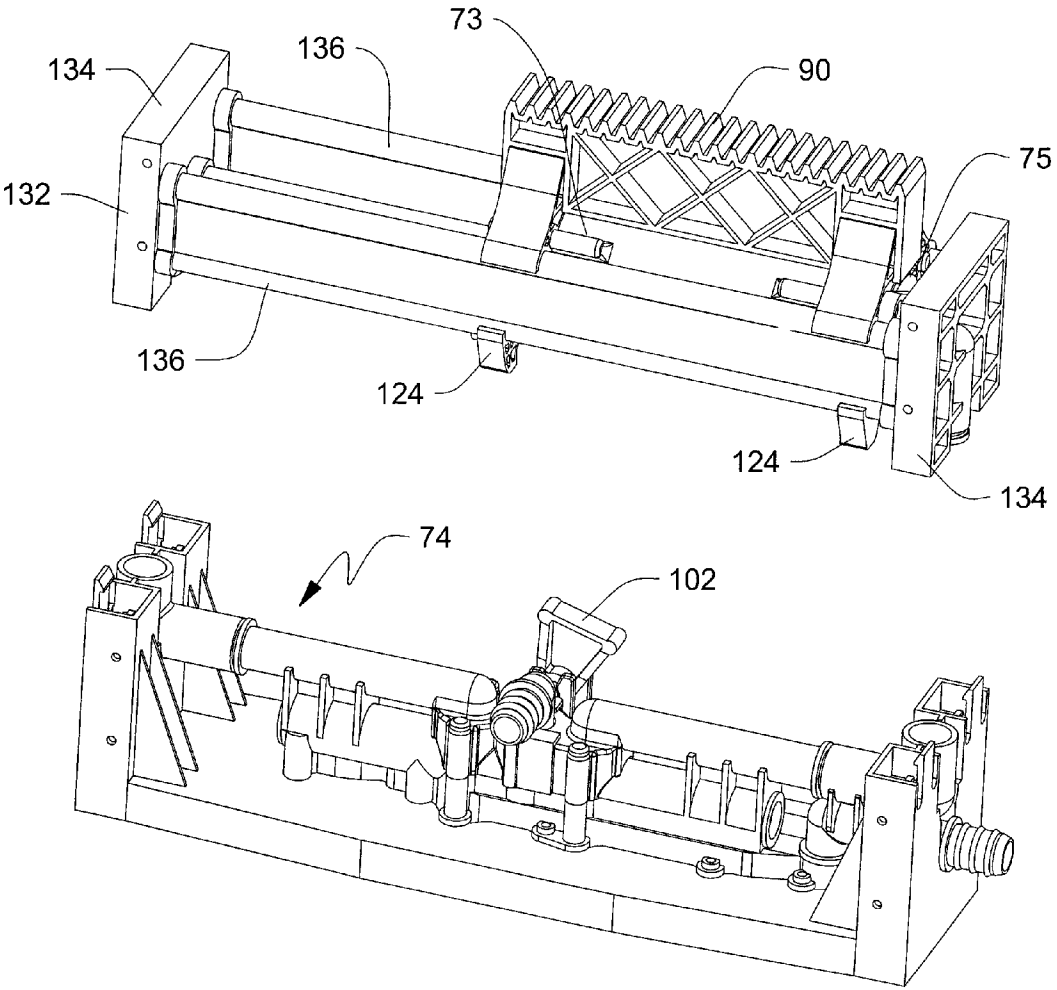
FIG. 16 is an exploded view of the switching assembly and traversing cylinder forming the motor assembly.

Now referring to FIGS. 5-16, depicted is a water motor housing 62 having a water inlet 70 which is coupled to a pressurized water spigot, not shown, to obtain pressurized water from a municipal supply or pressured well water supply. An exhaust water outlet 71 is used to expel water used to power the water motor (FIG. 13). The diverter handle 60 for use in directing water from the inlet to either the garden hose wherein the spool 20 may be free wheeled when the diverter handle is in a first raised position or to the motor when the diverter handle is in a second lowered position. An inlet diverted valve 116 directs the pressured inlet water to the out-tube 79 which passes into the center of the spool 20 for coupling to an end of the garden hose. The out-tube having a sealing o-ring to allow rotation of the spool without leakage of the water. When the diverter handle 60 is placed in the first lower position, the water flowing through the inlet 70 is directed through a fluid coupling line 72 to a switching valve 74. The switching valve is preferably a spool valve (FIG. 15) and preferably includes a valve body 118 having a plurality of suitably placed and sized apertures 120 for transferring water. Slidably located with the body 118 is at least one spool 122 operably connected to the toggle actuator 102 to cause the spool to translate within the body 118 for directing the fluid through the appropriate aperture 120 to cause motion of the cylinder 76. The switching valve may also contain a pilot valve portion 126 to balance the load on the spool 122 and allow easier translation of the spool. The switching valve is preferably mounted within a lower frame 130 that is constructed and arranged to cooperate with an upper frame 132 that contains the cylinder 76. The upper frame preferably includes a pair of end members 132 separated by a pair of guide rails 136. The guide rails are constructed and arranged to prevent rotation of the cylinder 76 during traversal thereof.

Figure 8:
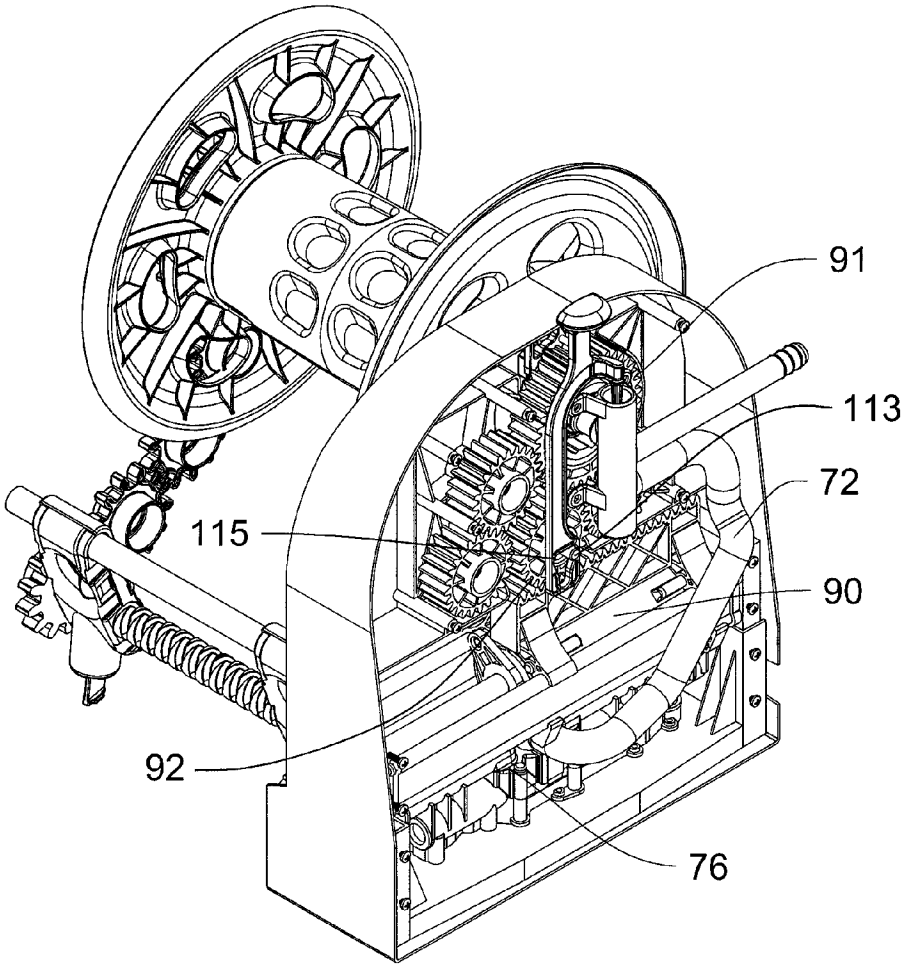
FIG. 8 is a perspective view of the drive mechanism for the water powered motor.
Figure 9:
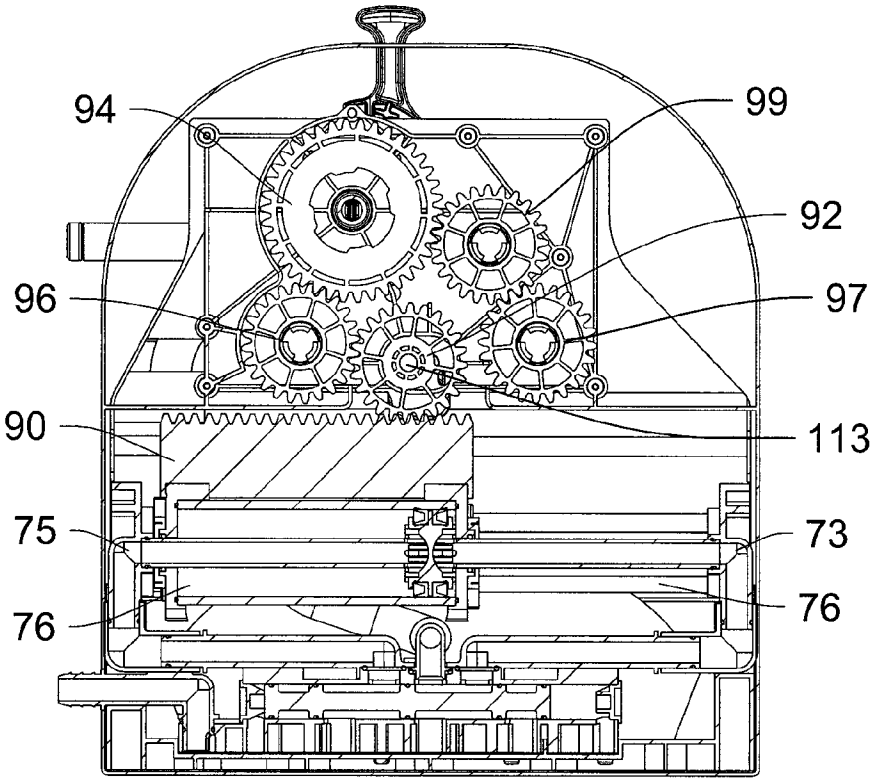
FIG. 9 is a plane view of the motor and drive mechanism.
Figure 10:
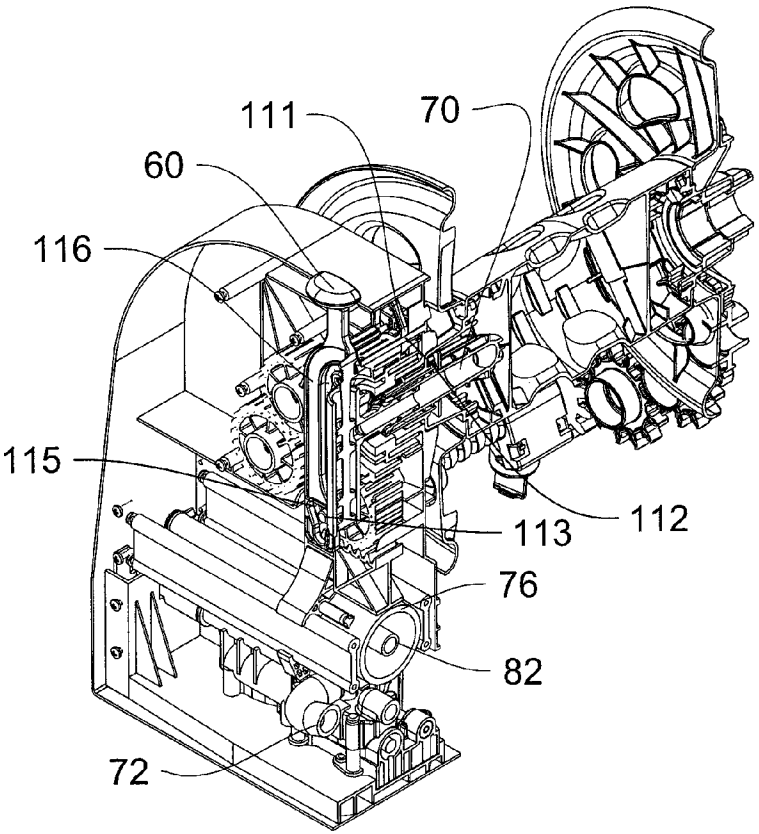
FIG. 10 is a cross sectional view of the motor and spool.
Figure 11:
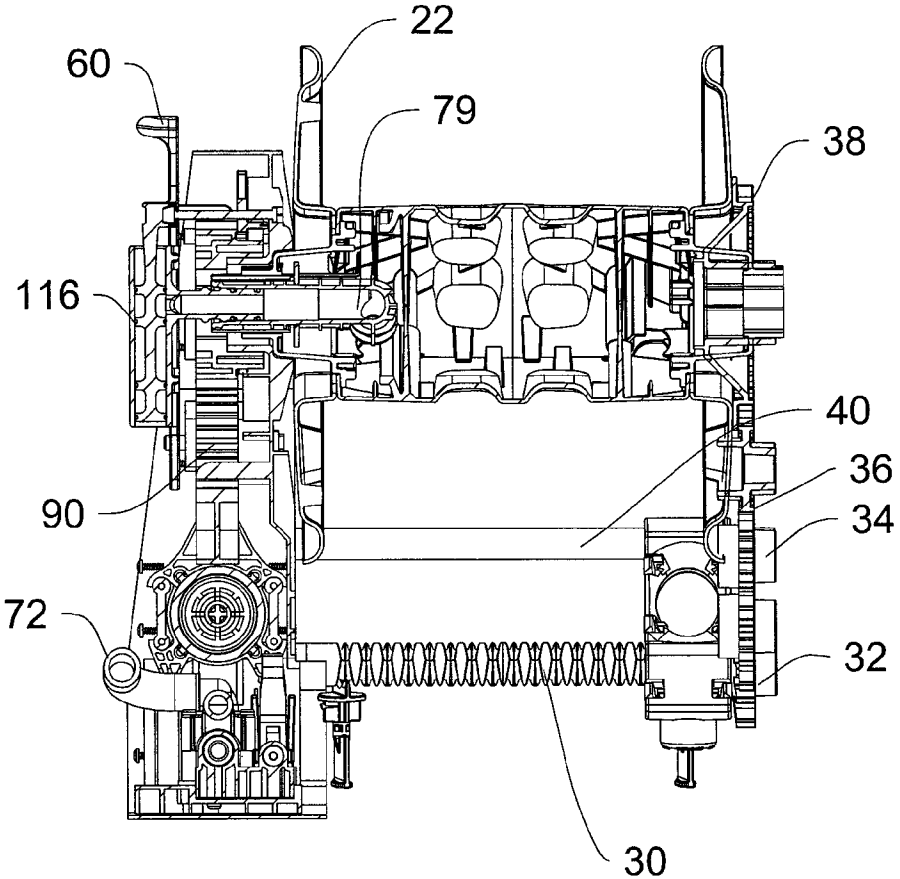
FIG. 11 is a cross sectional front view of the spool and motor assembly.

Still referring to FIGS. 5-16, the switching valve 74 is fluidly coupled to a first end 73 and a second end 75 of cylinder 76. The pressurized water is directed through the one of the end members 134 through hollow cylinder rod 140 to force the traversing cylinder 76 to move across a stationary piston 82. Linear motion of the traversing cylinder 76 is converted to rotational motion by use of a gear rack 90 which operates in conjunction with a first drive gear train 91 and a second drive gear train 93 (FIG. 12). As the traversing cylinder is moved in a first direction the gear rack 90 is moved along with the cylinder 76 along guide rails 136 causing gear 92 to engage and rotate gear 96 which drives spool gear 94. As the gear rack 90 traverses gear 92 traverses to engage the first gear 97 of the second drive gear train 93. Gear 92 includes a central axel 113 which fits into elongated slot 115 to control the movement path of gear 92. This construction allows gear 92 to traverse with the gear rack 90 until the gear 92 intermeshes with gear 96 or gear 97. Gear 97 is intermeshed with idler gear 99 that is intermeshed with spool gear 94. The idler gear 99 is provided to cause the spool gear to rotate in the same direction regardless of the movement direction of the cylinder. Once the gear rack 90 has then moved across to the opposite end of the cylinder housing, cylinder guide 124 again engages the toggle actuator 102 causing the switching valve to again move the spool 122 to divert the pressurized water to the now non-pressurized end of cylinder 76 resulting in a continuous traversing of the gear rack, and continuous rotation of the drive gear trains 91, 93 for rotation of the spool 22. A spring loaded clutch paw 111 prevents the spool from reversing direction during hose take-up and allows the spool to freewheel when the diverter handle is in the first raised position. In the preferred embodiment, the diverter handle includes a pin 110 that is constructed and arranged to cooperate with an aperture 112 in the clutch paw 111 to cause movement thereof when the diverter handle is moved. As shown in FIG. 8, when the diverter handle 60 is in a the lowered position gear 92 engages the gear rack 90 on top of the cylinder 76 further causing coupling to the idler gear 96 for operation of the spool gear 94. Gear 92 transverses between gears 96 and 97 which drives through gear 99 so as to cause spool gear 94 to rotate in one direction when the gear rack 90 moves back and forth along a horizontal plane. As mentioned previously, rotation of the spool results in operation of the level wind by rotation of the level wind gear train 38, 36, 34 and double helix screw 30 from attachment gear 32. It should be noted that while spur gears are illustrated other types of motion transfer assemblies may be utilized without departing from the scope of the invention, such motion transfer assemblies may include, but should not be limited to, belts and pulleys, friction wheels, bevel gears and shafting, cables and the like. It should also be noted that while a spool valve is illustrated other types of valves well known in the art may be utilized without departing from the scope of the invention.

Figure 5:
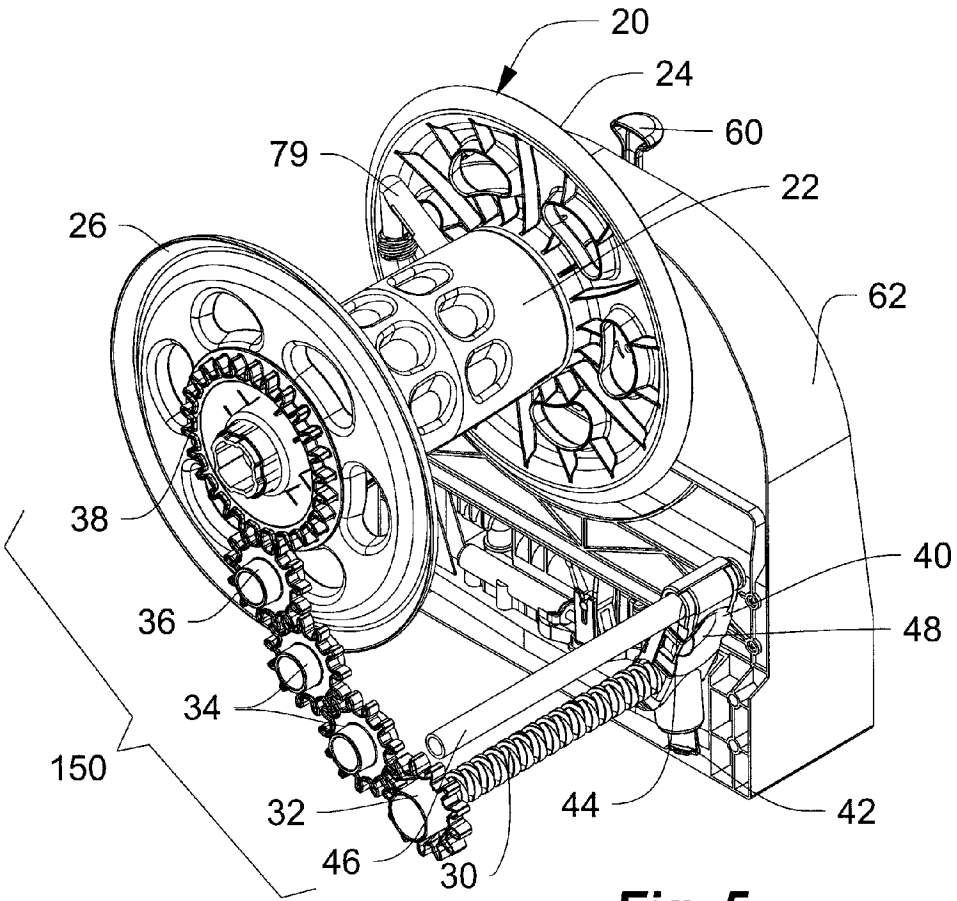
FIG. 5 is a perspective view of the spool, level wind, and motor.
Figure 6:
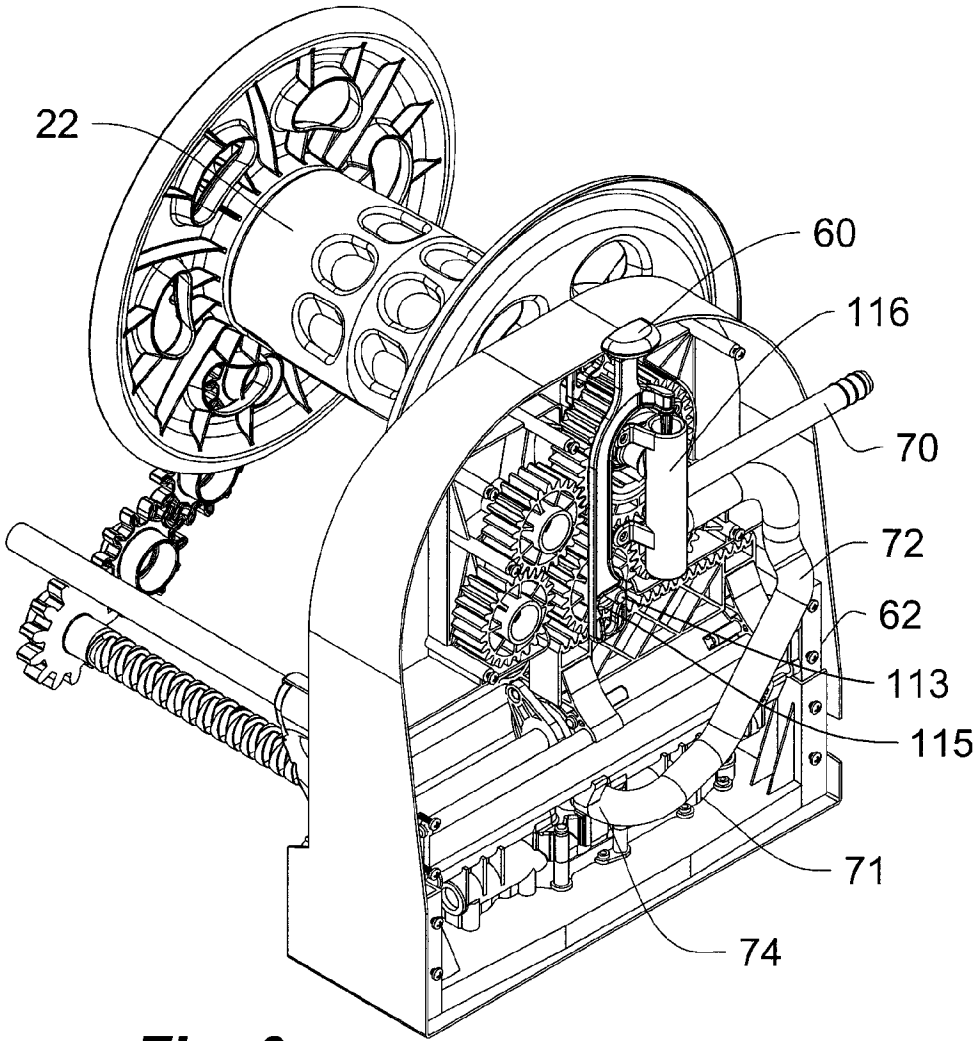
FIG. 6 is a rear perspective view of the spool and motor.
Figure 7:
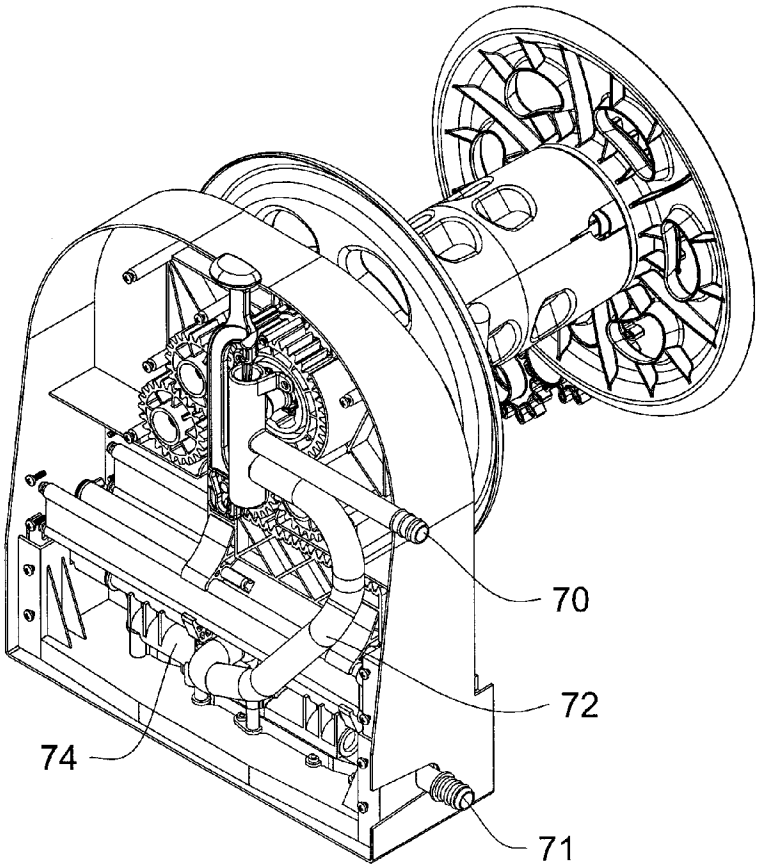
FIG. 7 is a left rear perspective view of the spool and motor assembly hosing.

FIG. 5 depicts the spool 20 having a central hub 22 and a pair of radial extending flanges 24 and 26 that are configured to accommodate a length of flexible garden hose wrapped around the hub 22. The flexible hose, not shown, may be properly placed upon the central hub by use of a level wind gear train 150 which utilizes rotation of the spool 20 to cause rotation of a double helix lead screw 30. The lead screw gear 32 is suitably secured to the lead screw 30 to cause rotation therewith. Idler gears 34 and 36 are positioned with the spool gear 38 and directly meshed thereto to provide the spacing necessary to allow accumulation of hose on the spool and desired positioning of the level wind assembly. Rotational movement of the spool gear 38 will cause similar rotational movement of the lead screw gear 32 and reciprocation of the hose guide 40. Preferably the spool gear 38 is larger than the lead screw gear 32 thereby achieving the desired amount of hose guide travel per spool revolution thereby providing compact hose storage configuration. Hose guide 40 includes a double helix lead screw release 42 that allows for consumer positioning of the hose guide 40 along the length of the double helix lead screw 30 by lifting of the release 42, which is spring loaded, and positioning the hose guide 40 in a desired location so as to cause proper placement of the hose in relation to the spool. The hose guide 40 has a lower U shaped channel 44 for positioning over an alignment support 46 so as to maintain the aperture 48 of the hose guide in a position relatively perpendicular to the entry of the garden hose. Operation of the spool 20 allows manual rotation of the spool by pulling of the garden hose through the hose guide when the diverter handle 60 is positioned so as to disengage the hydraulic motor that is preferably positioned within motor housing 62.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A water powered hose winding apparatus for use with an associated flexible hose comprising:

a spool having a hub defining an axis of rotation and a pair of flanges at opposing ends of said hub and perpendicular to said axis of rotation;

an enclosure having side wall panels, front and rear wall spacers extending between said side wall panels, said enclosure being constructed and arranged to receive said spool, said spool being rotatably mounted between said side wall panels;

a water powered reciprocating motor having a first and second inlet for receipt of pressurized water;

a switching valve for selectively directing pressurized water into said first or second inlet;

a gear rack secured to a portion of said reciprocating motor and moveable therewith;

a traversing gear intermeshed with said gear rack;

a spool gear rotatably coupled to said spool; and a first drive gear train including at least one drive gear for transferring rotation from said traversing gear to said spool gear.

2. The hose winding apparatus in accordance with claim 1 including a second drive gear train including at least one drive gear intermeshed with at least one idler gear for rotation therewith, said at least one idler gear intermeshed with said spool gear for rotation therewith, whereby rotation of said drive gear and said idler gear cause directional rotation of said spool upon engagement of said traversing gear and said drive gear.

3. The hose winding apparatus in accordance with claim 2 wherein said traversing gear alternatingly intermeshes with said first drive gear train and said second drive gear train to provide unidirectional rotation of said spool.

4. The hose winding apparatus in accordance with claim 2 wherein said traversing gear selector is coupled to said reciprocating motor allowing selective coupling of said traversing gear to said first and said second drive gear trains.

5. The hose winding apparatus in accordance with claim 1 wherein said spool gear is secured to said hub of said spool, said spool suitably journaled within said enclosure to allow rotational movement of said spool.

6. The hose winding apparatus in accordance with claim 1 wherein said water powered reciprocating motor is further defined as a stationary piston with a traversing cylinder, said traversing cylinder movable upon the insertion of pressurized water between an end surface of said piston and an end surface of said traversing cylinder.

7. The hose winding apparatus in accordance with claim 1 wherein said traversing gear converts the reciprocating movement of said gear rack to rotational movement.

8. The hose winding apparatus in accordance with claim 1 wherein said switching valve is timed to alternate the directing of pressurized fluid into said first or said second inlet to maintain the reciprocating motion of said traversing cylinder.

9. A water powered hose winding apparatus for use with an associated flexible hose comprising:

a spool having a hub defining an axis of rotation and a pair of flanges at opposing ends of said hub and perpendicular to said axis of rotation;

an enclosure having side wall panels, front and rear wall panels extending between said side wall panels, and a cover, said enclosure being constructed and arranged to receive said spool, said spool being rotatably mounted within said enclosure;

a water powered reciprocating motor having a first and second inlet for receipt of pressurized water to cause reciprocating movement of a portion of said motor;

a switching valve for alternating the direction of said pressurized water into said first or said second inlet causing operation of said reciprocating motor;

a gear rack secured to a portion of said reciprocating motor and moveable therewith;

a traversing gear intermeshed with said gear rack, said traversing gear converting reciprocating movement of said gear rack to rotational movement;

a first drive gear train including at least one drive gear constructed and arranged to intermesh with said traversing gear when said gear rack traverses in a first direction and a spool gear intermeshed with said at least one drive gear and coupled to said spool for rotation therewith;

a second drive gear train including at least one drive gear constructed and arranged to intermesh with said traversing gear when said gear rack traverses in a second direction, at least one idler gear intermeshed with said drive gear and a spool gear intermeshed with said at least one idler gear and coupled to said spool for rotation therewith;

wherein water pressure provides reciprocating movement of said gear rack by operation of said reciprocating motor, the gear rack rotating and traversing said traversing gear providing unidirectional rotation of said reel.

10. The hose winding apparatus in accordance with claim 9 wherein said first and said second drive gear trains cause unidirectional rotation of said reel upon engagement of said traversing gear.

11. The hose winding apparatus in accordance with claim 9 wherein said first and said second gear trains are alternatingly engaged to provide unidirectional rotation of said spool.

12. The hose winding apparatus in accordance with claim 9 wherein said traversing gear is rotatably coupled to said reciprocating motor to provide automatic alternating coupling of said traverse gear to said first or said second drive gear trains.

13. The hose winding apparatus in accordance with claim 9 wherein said spool gear is secured to said hub of said spool, said spool suitably journaled in said enclosure to allow rotational movement of said spool.

14. The hose winding apparatus in accordance with claim 9 wherein said water powered reciprocating motor is further defined as a stationary piston with a traversing cylinder, said traversing cylinder movable upon the insertion of pressurized water between a surface of said stationary piston and a closed end of said traversing cylinder.

15. The hose winding apparatus in accordance with claim 9 wherein said traversing gear converts the reciprocating movement of said gear rack to rotational movement.

16. The hose winding apparatus in accordance with claim 9 wherein said switching valve is timed to alternate the routing of said pressurized water into said first and second inlet to maintain the reciprocating motion of said traversing cylinder.

17. The hose winding apparatus in accordance with claim 9 further including a level wind assembly for directing a hose member onto said spool.

18. The hose winding apparatus in accordance with claim 17 wherein said level wind assembly includes a level wind gear train that utilizes rotation of said spool to cause rotation of a double helix lead screw.

19. The hose winding apparatus in accordance with claim 18 wherein said level wind gear train includes a spool gear and a lead screw gear intermeshed with at least one idler gear to provide the spacing necessary to allow accumulation of said hose on said spool, whereby rotational movement of said spool gear causes similar rotational movement of said lead screw gear and reciprocation of a hose guide.

20. The hose winding apparatus in accordance with claim 19 wherein said hose guide includes a double helix lead screw release that is constructed and arranged to allow positioning of said hose guide along the length of said double helix lead screw.

* * * * *